US007147020B2

(12) United States Patent
Bronner

(10) Patent No.: US 7,147,020 B2
(45) Date of Patent: Dec. 12, 2006

(54) CONTAINER WITH DRIP-RESISTANT MEASURING CAP

(76) Inventor: Nathaniel H. Bronner, 495 Carondelett CV SW., Atlanta, GA (US) 30331

( * ) Notice: Subject to any disclaimer, the term of this patent is extended or adjusted under 35 U.S.C. 154(b) by 159 days.

(21) Appl. No.: 10/906,484

(22) Filed: Feb. 22, 2005

(65) Prior Publication Data

US 2006/0185764 A1 Aug. 24, 2006

(51) Int. Cl.
*B65B 1/04* (2006.01)

(52) U.S. Cl. ..... 141/381; 215/DIG. 7

(58) Field of Classification Search ..... 141/379–381; 215/223–228, DIG. 7
See application file for complete search history.

(56) References Cited

U.S. PATENT DOCUMENTS 4,349,056 A 9/1982 Heino ..... 141/381
5,078,289 A 1/1992 Bolton et al. ..... 215/228
5,464,110 A * 11/1995 Heyworth ..... 215/223
6,609,639 B1 * 8/2003 Genthon ..... 222/571

* cited by examiner

*Primary Examiner*—Steven O. Douglas
(74) *Attorney, Agent, or Firm*—Richard D. Fuerle

(57) ABSTRACT

A container for holding a liquid has a vessel that is open at the top and has an externally threaded neck through which liquid may be poured. A cap that has an internally threaded neck through which liquid may be poured screws onto the vessel. The cap can be inverted and a measured amount of liquid can be poured from the vessel into the cap. The cap can be transparent or translucent and can marked to indicate the amount of liquid it holds. An annular lip on the inside of the cap above its internal threads is sloped on top and flat on the bottom. Any liquid remaining in the cap flows down the sides of the cap, over the annular lip, and drips into the vessel, thereby preventing the liquid from flowing in between the threads and down the sides of the vessel. The top of the vessel may be sealed with a heat seal. When the heat seal has been removed it can be replaced on top of the vessel and the flat bottom of the annular lip will press against it to prevent liquid from leaving the vessel.

20 Claims, 4 Drawing Sheets

CONTAINER WITH DRIP-RESISTANT MEASURING CAP

BACKGROUND OF THE INVENTION

This invention relates to a container that has a threaded cap that resists dripping and can be used to measure an amount of liquid. In particular, it relates to a container having a measuring cap where the cap has an annular lip that slopes on the top and is flat on the bottom.

When a measured amount of a liquid must be poured from a container, a separate container of known capacity or marked with gradations, such as a measuring spoon or a cup, is usually required. Since such measuring containers may not always be handy, liquids may be sold in containers that have threaded caps that can be used to measure the amount of liquid desired. However, after pouring the liquid from the cap, some liquid usually remains inside the cap. When the cap is replaced on the container, that liquid may move down between the threads and down the sides of the container. Depending on the liquid, this may create a sticky container or, if the liquid is flammable or toxic, a danger. Thus, it would be desirable to have a container with a measuring cap on it that prevents residual liquid in the cap from leaking to the outside of the container.

SUMMARY OF THE INVENTION

I have invented a container for holding liquids that has a threaded cap. The cap will hold a known amount of liquid, so that a known amount of liquid can be poured from the container into its cap. After the liquid in the cap is poured from the cap, the cap can be screwed back onto the top of the container. On the inside of the base of the cap above its threads is an annular lip that is flat on the bottom and sloped on the top. Thus, when the cap is replaced on the container, any liquid remaining inside the cap drains down the inside of the cap, over the lip, and drips into the container away from the threads. This prevents the liquid from entering between the treads on the cap and the container, so that it cannot drain down the outside of the container.

A heat seal may be placed on the top of the neck of the container to prevent the liquid from entering the cap before the container is first opened. The bottom of the annular lip is flat so that the lip presses against the heat seal and helps to keep it in place.

DESCRIPTION OF THE PREFERRED EMBODIMENTS

Figure 1:
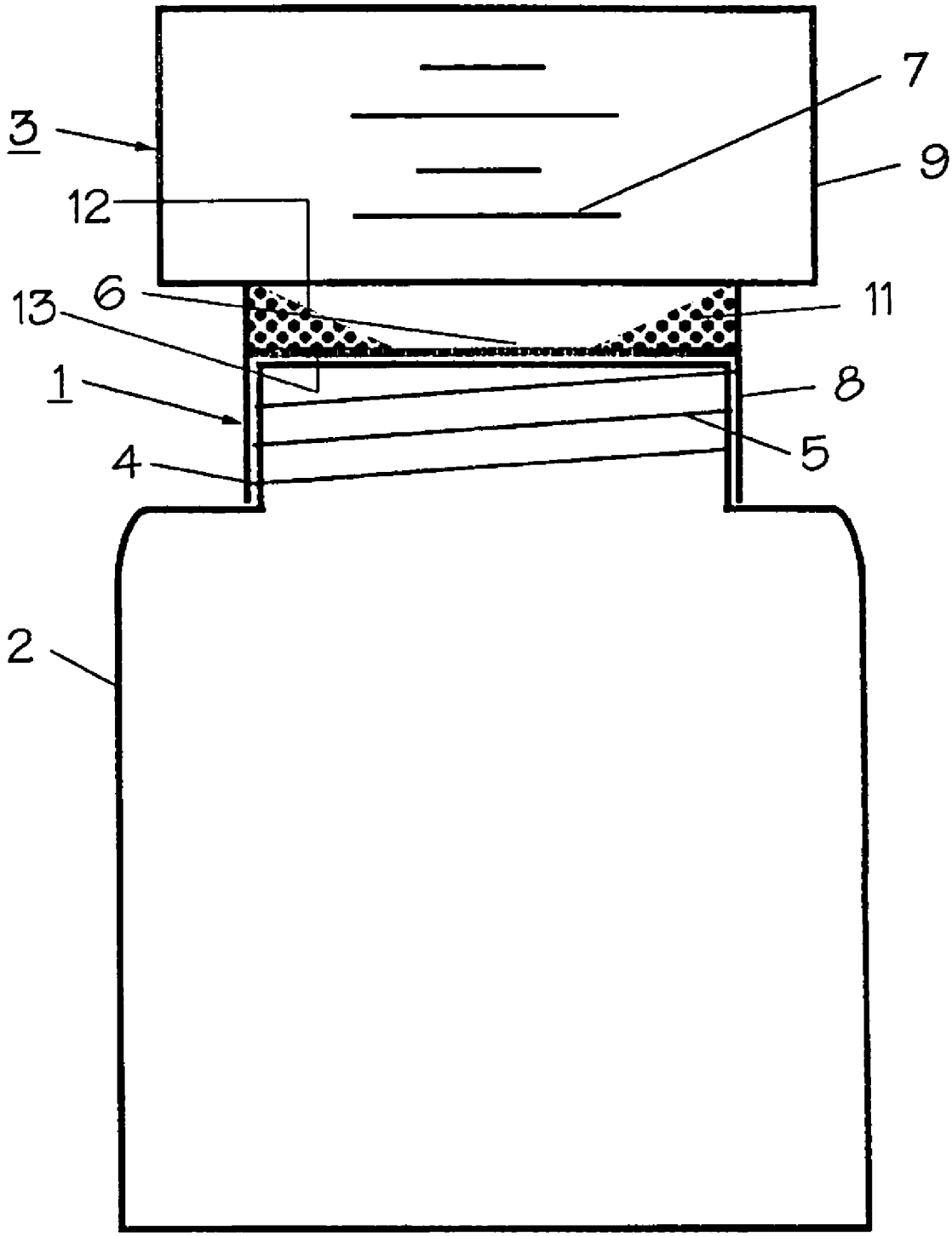
FIG. 1 is a diagrammatic side view in section of a certain presently preferred embodiment of a container according to this invention.

In FIG. 1, container 1 has two parts, a vessel 2, for holding a liquid, and a cylindrical cap 3. Vessel 2 has a neck 4, circular in cross-section, from which liquid may be poured. Neck 4 is provided with external threads 5. Vessel 2 is preferably made of plastic, but may also be made of other materials, such as glass, ceramic, metals, etc.

The opening in neck 4 is sealed by heat seal 6. Heat seal 6 is a flat wafer or disk and may be made of aluminum/polymer, waxed cardboard, or other materials, as is known in the art. It may be sealed to the top of vessel 2 by induction sealing, adhesive, or other means. Before container 1 is first opened, heat seal 6 prevents liquid from leaving vessel 2 and possible leaking out of container 1 if cap 3 is loose. Also, if heat seal 6 is removed or tampered with, the damage is usually visible and a potential customer is thereby warned not to buy the product.

Cap 3 is preferably also made of plastic, but may be made of glass, ceramic, metals, etc., if desired. Cap 3 is preferably transparent or translucent so that the level of liquid in it can easily be discerned. Cap 3 is provided with at least one horizontal mark 7 (a line, indentation, or protuberance) that indicates a quantity of liquid held within it; a number of marks may be used to indicate different amounts of liquid. Cap 3 has a neck 8 and a measuring portion 9. Neck 8 is circular in cross-section and is provided with internal threads 10 that engage external threads 5 at the neck 4 of vessel 2. Measuring portion 9, which holds the liquid when cap 3 is inverted, is preferably flat on top so that it may be rested on a horizontal surface.

Figure 2:
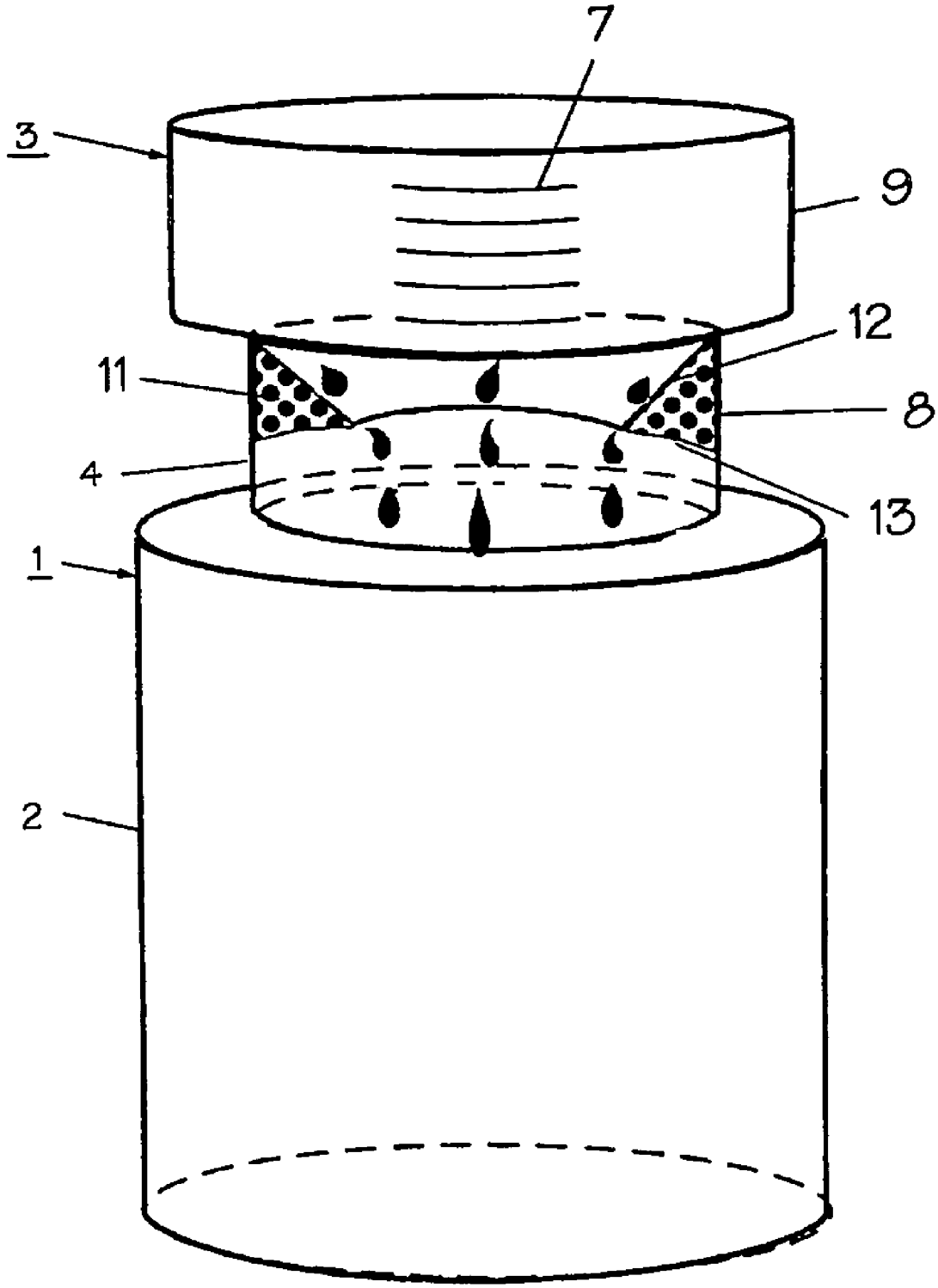
FIG. 2 is an isometric view, partially in section, of the container shown in FIG. 1 after the heat seal has been removed and the cap used and replaced.

Referring particularly to FIG. 2, inside cap 3 above threads 10 is internal annular lip 11. Lip 11 is an integral part of cap 3, which means that it is not a separate gasket or ring that is inserted into cap 3, but is part of cap 3. For example, if cap 3 is made of molded plastic, lip 11 will be molded as part of cap 3. Lip 11 serves two purposes. First, the upper surface 12 of lip 11 is sloped towards the center of cap 3, so that when cap 3 is replaced onto vessel 2 any liquid remaining in cap 3 drains down the sides of cap 3 and drips into the center of vessel 2, as shown in FIG. 2. This prevents the liquid from entering between threads 5 and 10. Second, the lower surface 13 of lip 11 is flat and horizontal and contacts and rests on heat seal 4, as shown in FIG. 1. In prior art containers, the heat seal is removed and discarded because, once it is removed, it will no longer seal the container if it is replaced. However, in this invention, if heat seal 4 is replaced after removal, lower surface 13 will press against heat seal 4 and prevent or reduce leakage from the top of vessel 2 into cap 3. Preferably, lip 11 has a slope of about 20 to about 60 degrees (measured from the horizontal), although other angles may also be suitable. The amount that the lip extends inward may depend upon the diameter of the cap. For example, the lip on a 24 mm diameter cap may extend inwardly about ⅛ to about ⅜ inches, while the lip on a 70 mm cap might extend inward about ¼ to about ¾ inches or more.

Figure 3:
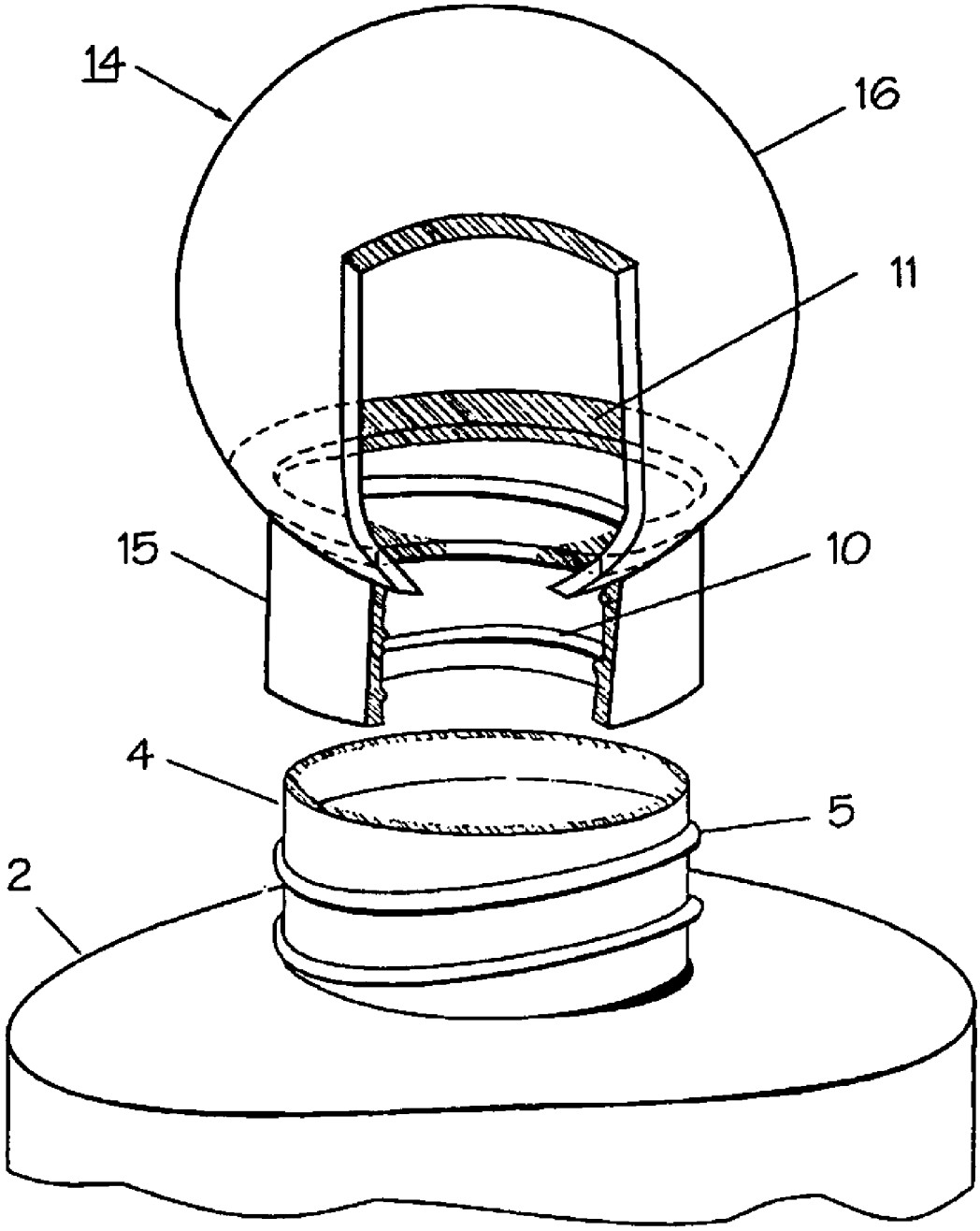
FIG. 3 is partially cut-away isometric view of a vessel having a spherical cap.
Figure 4:
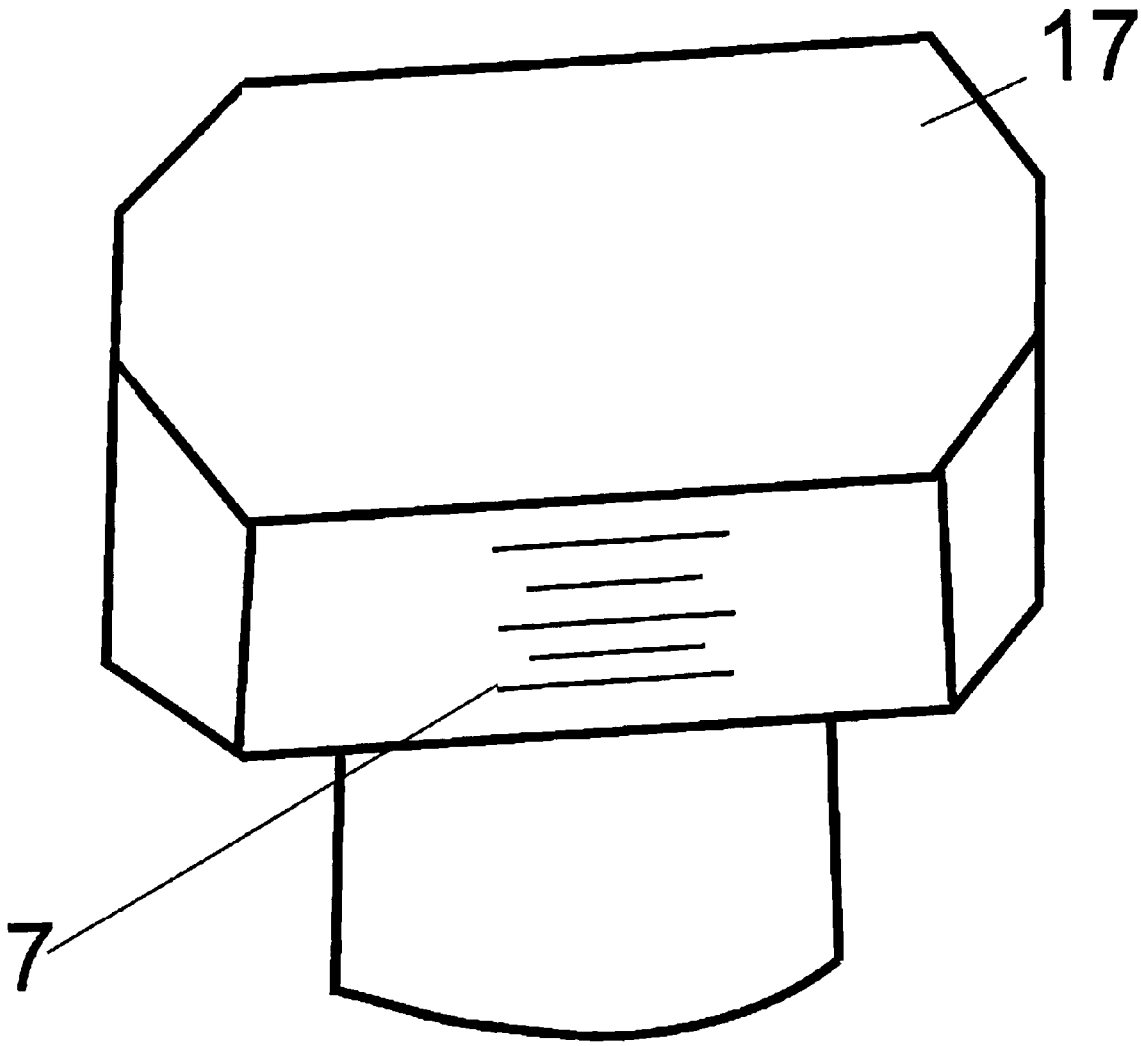
FIG. 4 is an isometric view of an octagonal cap.

The cap may have a variety of designs to suit the purpose of the container. FIG. 3 shows a spherical cap 14, which may be aesthetically more attractive for some containers. The interface between neck 15 and measuring portion 16 may be used to indicate the amount of liquid held. FIG. 4 shows an octagonal cap 17 which, like cylindrical cap 3, can be inverted and rested on a horizontal surface.

The container may used to hold any liquid. For example, it may carry medicinal or nutritional liquids, potable drinks, such as water, juices, soft drinks, alcoholic beverages, etc., or it may hold various fluids or chemicals, such as oil, transmission fluid, cleaning fluids, etc.

What is claimed is:

1. A container for holding a liquid comprising (A) a vessel that is open at the top and has an externally threaded neck through which liquid may be poured;

(B) a cap that has an internally threaded neck through which liquid may be poured, whereby said cap can be inverted and a measured amount of said liquid can be poured from said vessel into said cap; and (C) an annular lip on the inside of said cap above said internal threads that is sloped on top and flat on the bottom.

2. A container according to claim 1 wherein said lip is an integral part of said cap.

3. A container according to claim 1 wherein the slope on said lip is about 20 to about 60 degrees from the horizontal.

4. A container according to claim 1 wherein said lip extends about ⅛ to about ⅜ inches inward.

5. A container according to claim 1 wherein said vessel is made of molded plastic.

6. A container according to claim 1 wherein said cap is made of molded plastic.

7. A container according to claim 1 wherein the neck of said vessel is sealed with a heat seal.

8. A container according to claim 7 wherein said flat bottom rests on said heat seal.

9. A container according to claim 1 wherein said cap has a measuring portion and a threaded neck.

10. A container according to claim 9 wherein the top of said measuring portion is horizontal.

11. A container according to claim 1 wherein said measuring portion is cylindrical.

12. A container according to claim 1 wherein said measuring portion is polygonal.

13. A container according to claim 1 wherein said measuring portion is spherical.

14. A container according to claim 1 wherein said measuring portion is transparent.

15. A container according to claim 1 wherein said measuring portion is translucent.

16. A method of dispensing liquids comprising filling a container according to claim 1 with a liquid, pouring a measured amount of said liquid into said cap, and pouring said measured amount out of said cap.

17. A container for holding a liquid comprising (A) a vessel having a neck that has external threads, where liquid may be poured from said vessel through said neck;

(B) a cap having a measuring portion and a neck that has internal threads that engage said external threads, where said cap is capable of holding a measured amount of liquid when inverted;

(C) an annular lip on the inside of the neck of said cap above said internal threads that is an integral part of said cap and is sloped on top and flat on the bottom; and (D) a heat seal covering the top of said vessel and sealing liquid therein, where the bottom of said lip rests on the top of said heat seal.

18. A method of dispensing liquids comprising filling a container according to claim 17 with a liquid, pouring a measured amount of said liquid into said cap, and pouring said measured amount out of said cap.

19. A container for holding a liquid comprising (A) a plastic vessel having a neck that has external threads, where liquid may be poured from said vessel through said neck;

(B) a plastic cap having a measuring portion and a neck that has internal threads that engage said external threads, where said cap is capable of holding a measured amount of liquid when inverted;

(C) at least one horizontal mark on said cap for indicating an amount of liquid held within said cap;

(D) a plastic annular lip on the inside of the neck of said cap above said internal threads that is an integral part of said plastic cap and is sloped on top and flat on the bottom; and (E) a heat seal covering the top of said vessel and sealing liquid therein, where the bottom of said lip rests on the top of said heat seal.

20. A method of dispensing liquids comprising filling a container according to claim 19 with a liquid, pouring a measured amount of said liquid into said cap, and pouring said measured amount out of said cap.

* * * * *